US006471587B1

(12) United States Patent
Wood et al.

(10) Patent No.: US 6,471,587 B1
(45) Date of Patent: Oct. 29, 2002

(54) GAME METHOD AND DEVICE THEREFOR

(76) Inventors: Michael W. Wood, 11831 Wentling Ave., #C, Baton Rouge, LA (US) 70816; Terry L. Wilson, 6212 Stumberg La., Apt. 508, Baton Rouge, LA (US) 70816

( * ) Notice: Subject to any disclaimer, the term of this patent is extended or adjusted under 35 U.S.C. 154(b) by 391 days.

(21) Appl. No.: 09/047,147

(22) Filed: Mar. 24, 1998

(51) Int. Cl.[7] ..... A63F 1/00

(52) U.S. Cl. ..... 463/13; 463/16; 463/17; 463/20; 273/143 R; 273/292

(58) Field of Search ..... 273/303, 306, 273/149 P, 143 R, 274, 292; 463/16–17, 22, 25–28, 11–13

(56) References Cited

U.S. PATENT DOCUMENTS 4,706,961 A * 11/1987 Singleman et al. ..... 273/274
5,019,973 A * 5/1991 Wilcox et al. ..... 364/412
5,033,744 A * 7/1991 Bridgemna et al. ..... 273/85 CP
5,224,706 A * 7/1993 Bridgeman et al. ..... 273/85 CP
5,255,915 A * 10/1993 Miller ..... 273/85 CP
5,531,440 A * 7/1996 Dabrowski et al. ..... 463/12
5,591,081 A * 1/1997 Suzuki ..... 463/13
5,816,915 A * 5/1997 Kadlic ..... 463/13
5,732,950 A * 3/1998 Moody ..... 273/392
5,755,621 A * 5/1998 Marks et al. ..... 463/42
5,823,873 A * 10/1998 Moody ..... 463/13
5,863,041 A * 1/1999 Boylan et al. ..... 273/292
5,947,821 A * 9/1999 Stone ..... 463/13

FOREIGN PATENT DOCUMENTS

GB 2113881 A * 8/1983

* cited by examiner

*Primary Examiner*—M O'Neill
*Assistant Examiner*—Carmen D. White
(74) *Attorney, Agent, or Firm*—John Edward Roethel

(57) ABSTRACT

A game method and device are set forth wherein pairs of hands are exposed to the player. If one of the pairs has a qualifying holding, the game method provides for the exchange of indicia between the hands to increase the reward to be received by the player. Where the game is based upon the use of playing cards, two hands of five cards each are exposed to the player. If one of the hands has a qualifying holding such as a pair of 7s or better, the player can exchange cards between the hands to increase the poker ranking of one or both of the hands. The reward is based upon the ranking of the hands. The device for practicing the game may provide for automatic transformation to obtain the best possible outcome.

16 Claims, 7 Drawing Sheets

GAME METHOD AND DEVICE THEREFOR

FIELD OF THE INVENTION

The present invention relates to wagering games and more particularly to slot machine and video-poker types of wagering games.

BACKGROUND

Wagering games and methods therefor concerning slot machines and video poker machines are played by a growing population of gamblers for fun and enjoyment. A slot machine, as distinguished herein from a video poker machine (often slot machines and video poker machines are collectively referred to as "slots"), do not provide the player with any choices or options other than the amount to be wagered. An example is a common, electromechanical, three-reel slot machine. This machine includes three reels each having thereon a plurality of stops each having associated therewith a "blank" or a symbol. The player makes their elected wager and initiates play. Upon initiation, a drive unit spins the reels which eventually come to a stop. The symbols or blanks aligned along one or more paylines defines the outcome(s) for the play of that spin, sometimes referred to as the "hand". The spinning reels either mechanically randomly select the outcome or, under the control of a processor, the outcome is randomly selected and displayed by the reels. The selected outcome is compared to a predetermined schedule of winning outcomes, e.g. bar-bar-bar symbols. If the outcome is a winning outcome, the player is paid based upon their wager. If the outcome is a losing wager the player loses their wager.

Modernly, the electromechanical slot machines are becoming replaced by processor controlled slot machines. These machines include a video display terminal (VDT) which displays the various action during the play of the game. The player makes their chosen wager, constrained by the minimum and maximum wager for the machine, and initiates play. Upon initiation, the processor randomly selects, from data stored in memory, symbols and blanks defining the outcome for the hand. The display is driven by the processor to simulate spinning reels which slow and stop to replicate the processor selected outcome. If the outcome is a winning outcome, the player is paid. If the outcome is a losing outcome, the player's wager is lost and is retained by the machine.

In either version of the slot machine, the player's only choice is the amount of the wager. Thereafter the ultimate outcome is out of the player's hands. Some gaming jurisdictions only permit non-decisional gaming machines such as slot machines.

Video poker provides the player which some decisions which affect the ultimate outcome. As such, a skilled player has an advantage over an unskilled player in that the skilled player will play the machine such that the outcomes obtained more closely match mathematical probabilities and payoff frequencies for the machine. A poor player can make poor decisions affecting the payoff frequency obtained by the player. Because decisions are involved, some gaming jurisdictions do not permit such machines to be played.

A video poker machine includes a VDT and a processor which operates the various features of the machine. As is known, a player inputs a selected wager and prompts the machine. The processor selects from data stored in memory representing each card of a deck of cards, e.g. the fifty-two cards of a standard deck of cards, data representing five cards which are displayed as a five card hand at the VDT. The player opts to discard some or none of the initial cards and prompts a "draw". The "draw" prompts the processor to display replacement cards for the discarded cards, if any, to obtain a final outcome of a final five card poker hand for the game. This final hand is compared to a schedule of hand card combinations to determine if the player has obtained a winning outcome. Winning outcomes are paid based upon the player's wager and losing outcomes are lost and are retained by the machine.

A drawback of the prior art slot machines is that typically the player has only one opportunity to obtain the best outcome they can. There is no opportunity for a player of a multiple payline slot machine to move symbols from one payline to another to increase their payoff. In video poker, there is no opportunity for a player to exchange cards between displayed first and second five card hands to likewise increase their payoff. It would be desirable to provide a game which, from an initial display of two hands, symbols could be exchanged between the hands to increase the player's reward.

SUMMARY OF THE INVENTION

There is, therefore, set forth according to the present invention a gaming device and method which can provide the player with opportunities to increase their reward by exchanging indicia between separately displayed hands.

Toward this end the method includes selecting indicia such as representations of playing cards and presenting them as a first hand and a second hand to a player. Certain hand indicia combinations are designated as winning outcomes with the remainder designated as losing outcomes. Upon viewing the first and second hands the player opts to rearrange the hands by exchanging one or more indicia between the hands attempting to obtain at least one winning outcome or to better their outcome(s) for the hands. If one or both of the hands comprises a winning outcome combinations of indicia, the player is rewarded. Otherwise, the player loses.

In a preferred embodiment the indicia are representations of playing cards. The player makes a wager and two, separate, five card hands are displayed. If one of the hands has a qualifying holding of cards, e.g. a pair of 7's or better, the player is given the option to exchange cards between the two hands to increase their expected reward. For example, where the reward is based upon the ranking of hands according to the rules of Poker, the player may opt to move cards to increase the Poker ranking of one or both of the hands to increase their reward. After the player has exercised their option, the final hands are compared to a schedule of winning outcome hands and, if either or both of the hands represent winning outcomes, the player is rewarded based upon the ranking of the hands.

As an example, the initial hands displayed may be:

| Hand 1 | Hand 2 |
|---|---|
| Queen (Hearts) | Queen (Spades) |
| Queen (Clubs) | 4 (Spades) |
| Queen (Diamonds) | 9 (Spades) |
| Ace (Hearts) | Jack (Spades) |
| 2 (Spades) | 10 (Spades) |

Since one of the hands has a qualifying holding (three Queens), the player is given the option to exchange cards between the two hands. The recommended play would be for the player to exchange the 2 (Spades) with the Queen (Spades) to obtain for Hand 1 a Four-of-a-Kind and for Hand 2 a Spade flush. This would maximize the player's reward since the rankings of both hands have been increased.

The device according to the present invention includes means for the player to register a wager to play the game. A processor is provided which has a first data structure representing a plurality of indicia such as, in the preferred embodiment, data representing each card of a deck of cards. A display is adapted to display the hands for the play of the game. The processor is configured to select from the first data structure and display a plurality of indicia as an initial first and a second hand. Where the indicia are playing cards, the processor randomly selects and displays initial first and second hands of five cards each representing Stud Poker hands. A second data structure is provided which includes data representing winning outcome combinations of indicia for a hand. The processor is adapted to compare the indicia combinations of the initial first and second hands to the combinations of the second data structure to determine if at least one of the initial first and second hands has a predetermined combination. If the processor determines that a predetermined combination exists, means are provided to enable the player to exchange indicia between said initial first and second hands to form final hand combinations of indicia. The processor is further adapted to compare the final hand combinations to the combinations of outcomes of said second data structure and, based upon the outcomes, reward the player based upon the outcome combinations of indicia of the final hands.

In a further embodiment of the method, the player is not given any decision as to whether or not to exchange indicia between the displayed hands. According to this embodiment if one or both of the displayed first and second hands of indicia have a predetermined holding, the processor is adapted to automatically exchange indicia to maximize the reward paid to the player for the game.

As can be appreciated, the method and device of the present invention provides in one aspect, the player with an option to move indicia, e.g. representations of playing cards, between two hands to maximize the ultimate reward to be received by the player. In another embodiment, the exchange occurs without any decisional input by the player. Thus, where the player has decisional input, the player can exercise certain strategies to maximize their reward. Further, in either embodiment, the combinations of both hands can create situations where large jackpots can be offered such as in the rare occasion that the player obtains two Royal Flushes, two Four-of-a-Kinds or the like. The offering of large jackpots provides excitement from the player's perspective and, from the casino's perspective, is an enticement for players to play the game.

BRIEF DESCRIPTION OF THE DRAWINGS

These and other features and advantages will become better appreciated with reference to the description, claims and drawings wherein:

DESCRIPTION

Figure 1:
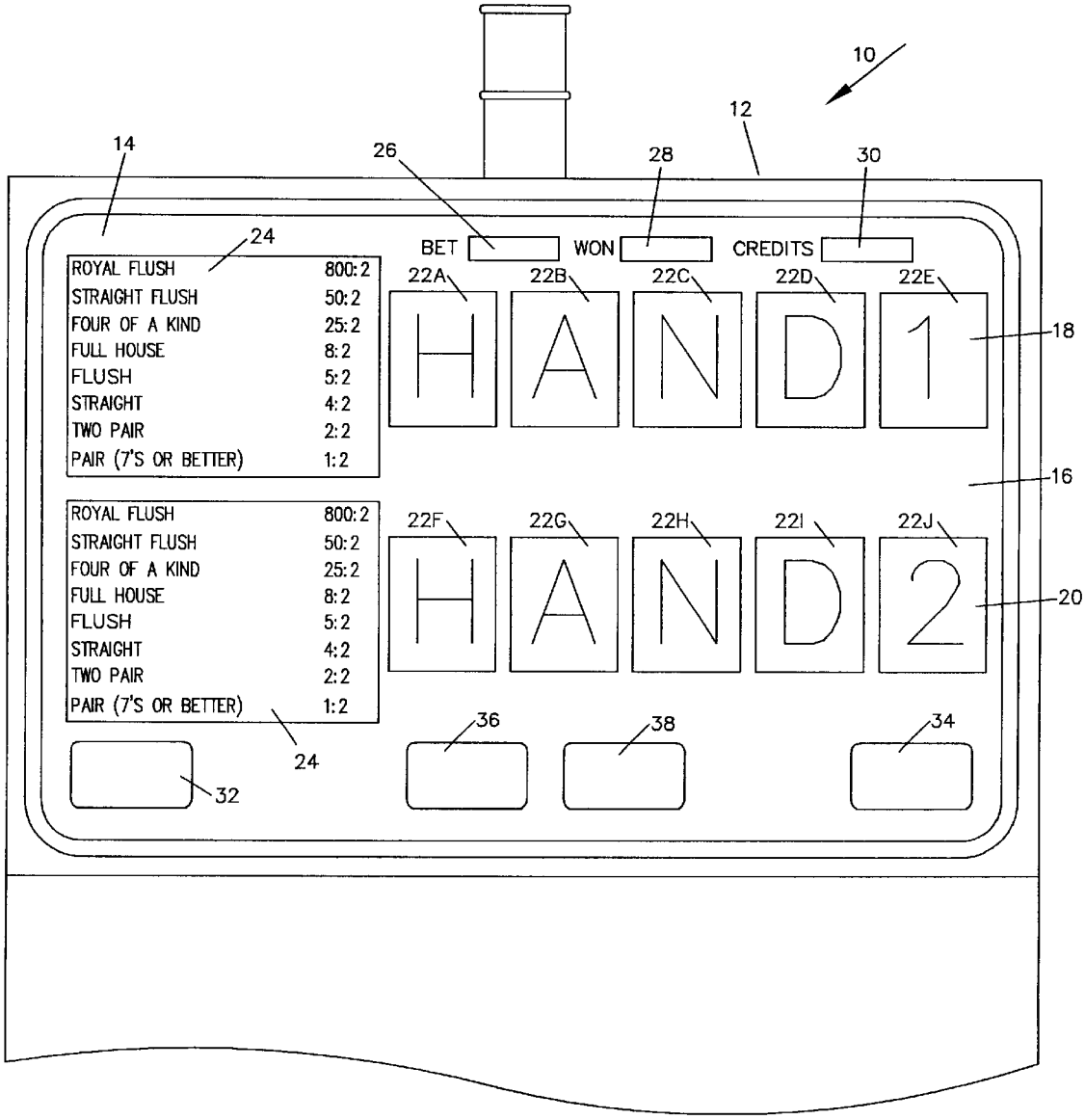
FIG. 1 is a partial from view of a device for playing the game of the method of the present invention showing an opening presentation for play.

Turning to the drawings, FIG. 1 shows a device 10 adapted to play the game according to the method of the present invention. The configuration of the device 10 may be similar to slot machines as are well known in the art. Accordingly, the device 10 includes a housing 12 which houses the components of the device 10 including a processor adapted to control the various functions and aspects of the device 10. A display 14, preferably a video display including a touch screen feature, is disposed in the housing 12. It is to be understood that while the preferred embodiment provides the display with a touch screen for controlling the play of the game of the method according to the present invention, that other data input devices such as buttons, key pads or mouses could be used.

With continuing reference to FIG. 1, the video display 14 displays during the play of the game an action area 16 which is controlled by the processor of the device to display, according to the present invention, a first hand 18 and a second hand 20 for play by the player in the manner described below. Where the game according to the method is played using indicia of playing cards, and where winning combinations as described below are based upon the ranking of Poker hands, each of the first and second hands 18, 20 includes five cards, cards 22*a–e* for the first hand 18 and cards 22*f–j* for the cards of the second hand 20. In the opening presentation as shown at the display 14 the backs of the cards 22*a–j* are displayed and may be identified as "HAND 1" and "HAND 2."

Adjacent the action area 16, and associated with each of the first and second hands 18, 20, are pay tables 24 which describe each of the winning outcome combinations which can be obtained during the play of the game and provide the pay offs for obtaining that outcome. Again, where the embodiment of the present invention is based upon playing five card hands of Poker, the pay tables 24 listing the winning outcome combinations may be as shown in Table 1 below.

TABLE 1

| | |
|---|---|
| Pair of 7's or Better | 1:2 |
| Two Pair | 2:2 |
| Three of a Kind | 3:2 |
| Straight | 4:2 |
| Flush | 5:2 |
| Full House | 8:2 |
| Four of a Kind | 25:2 |
| Straight Flush | 50:2 |
| Royal Flush | 800:2 |

Also, the display 14 shows various meters illustrated as a bet meter 26, won meter 28 and credit meter 30. The bet meter 26 displays for the player the amount of the wager being made for the play of the game. The won meter 28 shows the player the amount won during the play of the game and the credit meter 30 shows the player the number of credits available to the player for wagering.

Below the action area 16 and pay tables 24 there is displayed certain buttons which, by the touch screen feature of the display 14, are used to control the play of the game of the method of the present invention. In the version of the game where the player is provided with a decision which effects the outcome of the game, the display 14 displays a set hand button 32 which, if touched by the player, will prompt the processor for the device to automatically reconfigure the first and second hands 18, 20 to obtain the maximum reward for the play of the game. Also provided is a deal button 34, which if touched, prompts the processor to initially select the cards 22*a–j* and to complete play as described below. To decrease the amount being wagered on any play, the display 14 displays a decrease bet button 36 and to increase the bet, an increase bet button 38. Prior to play of the game, the player uses the decrease bet button 36 and increase bet button 38 to change the amount of the wager as reflected at the credits meter 30.

With the various aspects of the device 10 described above, the method for play of the game according to the present invention using the device 10 will now be described with reference to FIGS. 1 through 3 and FIG. 7.

Figure 7:
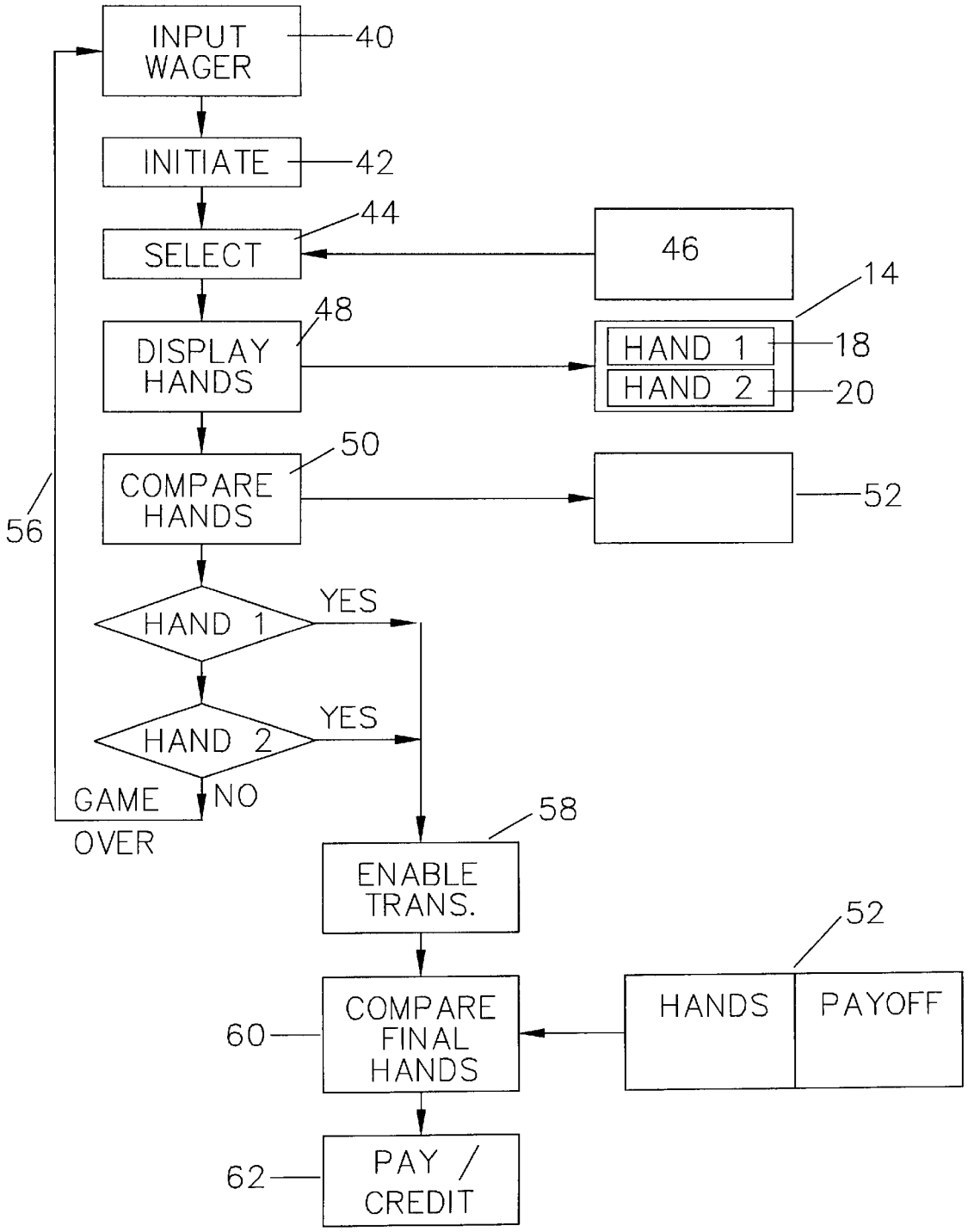
FIG. 7 is a diagram illustrating the method of the present invention.

The player first inputs coins into the device 10, in a Known manner, to make a wager shown as input wager 40 in FIG. 7. As is well known, these coins or tokens may be inserted into a coin slot provided on the device (not shown) or the player may insert paper currency into a cash reader (not shown) to accumulate credits available for wagering, the amount of credits available displayed at the credits meter 30. For example, if the device 10 is adapted to receive wagers in denominations of 25 cents, by inserting a $20 dollar bill into the cash reader, the device 10 will accumulate and display at the credits meter 30 eighty credits. The player, using the increase bet button 38 or decrease bet button 36 alters the amount that the player wishes to bet for the play of the hand by altering the value displayed at the bet meter 26. Since two hands, the first hand and second hand 18, 20, are played according to the method of the present invention, all wagers should be in multiples of two in that the wager will be split between the first hand 18 and the second hand 20.

Figure 2:
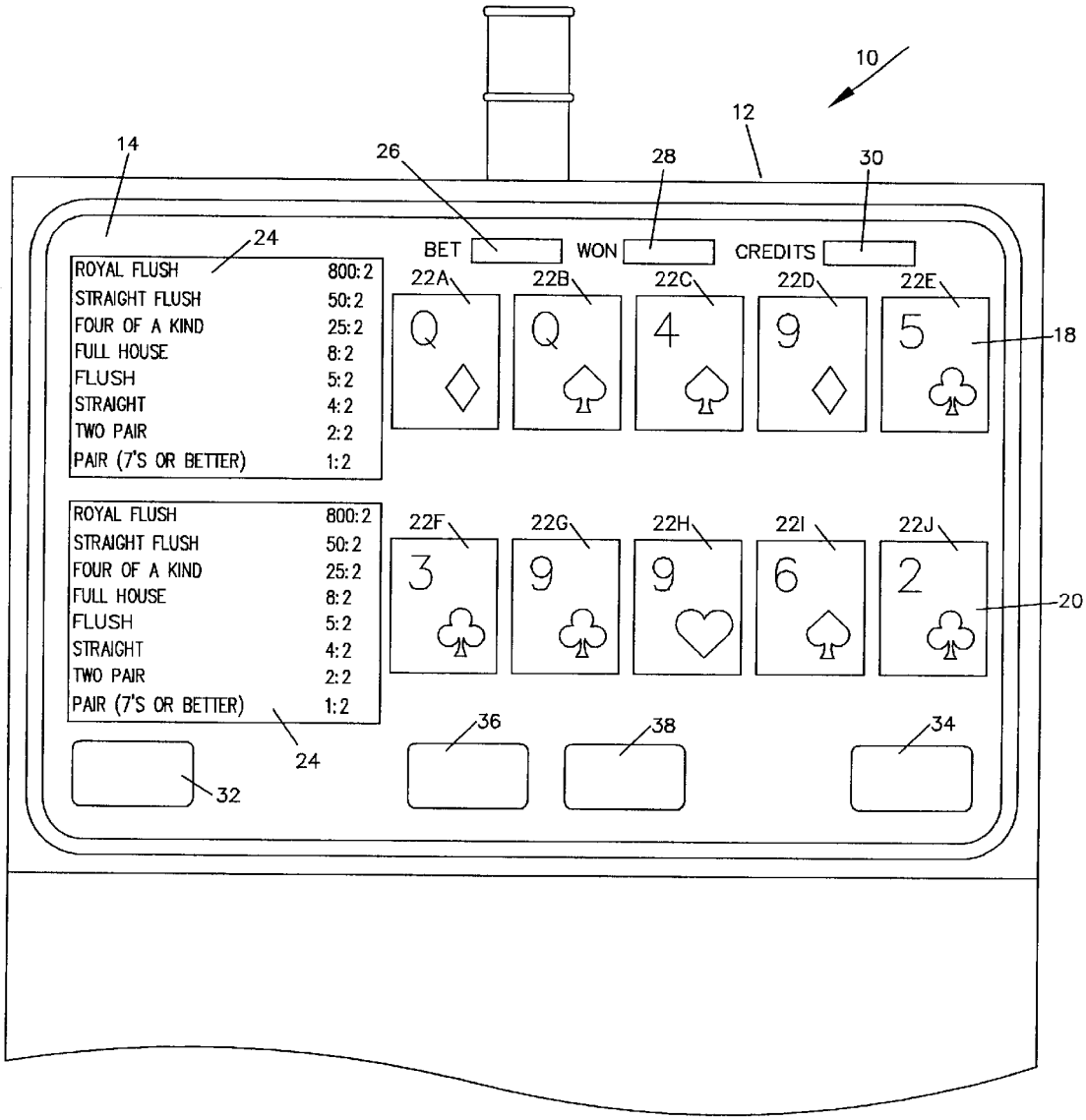
FIG. 2 is a view of the presentation of FIG. 1 showing the display of hands for play according to the method of the present invention.
Figure 3:
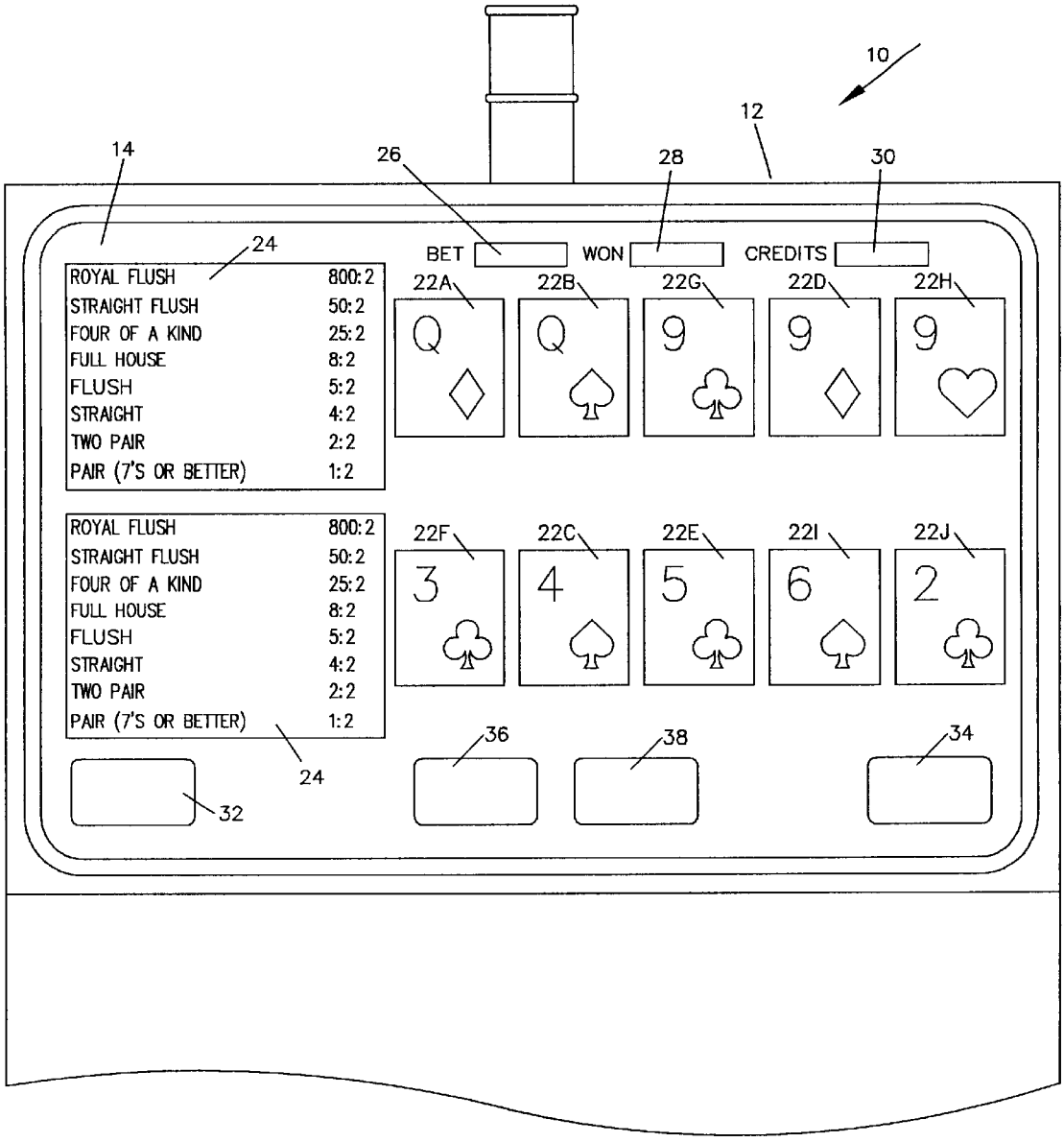
FIG. 3 is a view of the presentation of FIG. 2 showing the display of the hands as reconfigured according to the method of the present invention.

After the player has input their desired wager, the play is initiated at 42 by the player touching the deal button 34 at the display 14. The initial display for the play of the hand is as shown in FIG. 1, with the backs of the cards 22*a–j* shown and denoted as "HAND 1" and "HAND 2." Thereafter, the processor reveals each of the cards 22*a–e* of the first hand 18 and the cards 22*f–j* of the second hand 20 as shown in FIG. 2. Upon initiation, the processor selects at 44 randomly selects data representing 10 cards of a deck of 52 cards (or when the game is played as joker's wild, 53 cards, a standard deck of 52 cards plus a joker) from a first data structure 46 which includes data representing each of the cards available for selection. At 48, the cards 22*a–e* of the first hand 18 and the cards 22*f–j* of the second hand 20 are displayed as shown in FIG. 2. The processor compares the card combinations of the first hand 18 and the second hand 18, according to the preferred embodiment, to determine if either or both of the hands have a pre-determined, qualifying holding. According to the embodiment shown in FIGS. 2 and 3, and as reflected in Table 1 above, each of the hands are compared at 50 to data representing outcomes stored in a second data structure 52 to determine whether either or both of the hands has, a pre-determined, qualifying holding. As shown, according to this embodiment, the predetermined qualifying holding is that only one of the first or second hands 18, 20 need have a holding of a pair of 7s or better to continue with the play. If neither of the first or second hands 18, 20 has the aforesaid pre-determined holding, the game is over and the player's wager is lost. As shown in FIG. 7, the processor at 54 compares the holding of the first hand 18 to the data of the second data structure 52 and the second hand 20 to the data of the second data structure 52 to determine if the pre-determined qualifying holdings are present. As shown by arrow 56, if neither of the first or second hands 18, 20 has the pre-determined qualifying holding, the game is over and the wager is lost for that play, and the player is returned to input another wager. If, on the other hand, one or both of the first and second hands 18, 20 have a pre-determined qualifying holding, shown in FIG. 2 as a pair of Queens for the first hand 18 and a pair of 9s for the second hand 20, the game at 58 enters the transformation phase in that transformation is enabled. If transformation is enabled, by one or both of the first or second hands 18, 20, having a pre-determined, qualifying holding, the player has the option to exchange cards 22*a–j* between the first and second hands 18, 20. The exchange, may be accomplished by the player first touching the card of the first hand 18 and then the card of the second hand 20 which the player wishes to exchange. As shown, with reference to FIG. 2, the player has the opportunity to increase their reward by exchanging cards such that the first hand 18 is a full. house and the second hand 20 is a flush. Accordingly, the player would touch card 22*c* of the first hand 18 and card 22*g* of the second hand 20 which would be exchanged and then touch card 22*e* of the first hand 18 (5 of clubs) and card 22*h* (9 of hearts) of the second hand 20 which would likewise be exchanged. Through such action, the first and second hands 18, 20 as displayed in FIG. 2 are transformed into the first and second hands 18, 20 as shown in FIG. 3. By the transformation, the player has increased their reward obtained by the play of the game.

Should the player, be confused or frustrated as to which cards to exchange between the first and second hands to increase their reward, the player can touch the set hands button 32 which will prompt the processor to make the exchange between the first and second hands to obtain the maximum reward. According to the example illustrated in FIGS. 2 and 3, had the player touched the set hands button 32, the exchange of the cards as described above would have been made to convert the first hand 18 into a full house and the second hand 20 into a straight.

After the player is satisfied with the transformation of the first and second hands 18, 20, the player touches the deal button 34 to prompt the processor at 60 to compare the combinations of the final first and second hands 18, 20 to the data of winning outcome combinations stored in the second data structure 52. Alternatively, if the player has touched the set hand button 32 to automatically transform the first and second hands, the player need not touch the deal button 34 in that the processor is prompted to automatically enter the compare final hands sequence. Once the processor has determined the final combinations obtained, it retrieves from the second data structure 52 the pay offs to be paid for each winning outcome. At 62, the processor pays for the winning outcomes according to the pay tables, showing the combined win by the player for both the first and second hand outcomes at the won meter 28 and allocating credits as shown at the credits meter 30. Alternatively, the device 10 could issue the requisite payoff by dispensing coins.

With the outcomes as shown in FIG. 3, had the player wagered 10 credits, they would have received for the first hand 18 a pay off of 40 credits and for the second hand 20, 20 credits for a total of 60 credits.

As can be appreciated, the game according to the present invention and as described above, can provide the player with strategies as to how to maximize their reward and gives the players options as to obtaining one or more of the outcomes of the first and second hands 18, 20. As can further be appreciated, because the player is arranging two Poker hands from a field of 10 cards 22*a–j*, outcomes of extremely low statistical probabilities of occurring can be obtained such as two royal flushes or a royal flush and a four-of-a-kind or the like. Because the probabilities of obtaining two royal flushes or the like is extremely remote, large jackpots or progressive jackpots can be offered for the play of the game. These large jackpots entice players to, play the game. Further, since the player has all 10 cards displayed and at their disposal for arranging the first and second hands 18, 20 the game creates a great deal of excitement.

Figure 4:
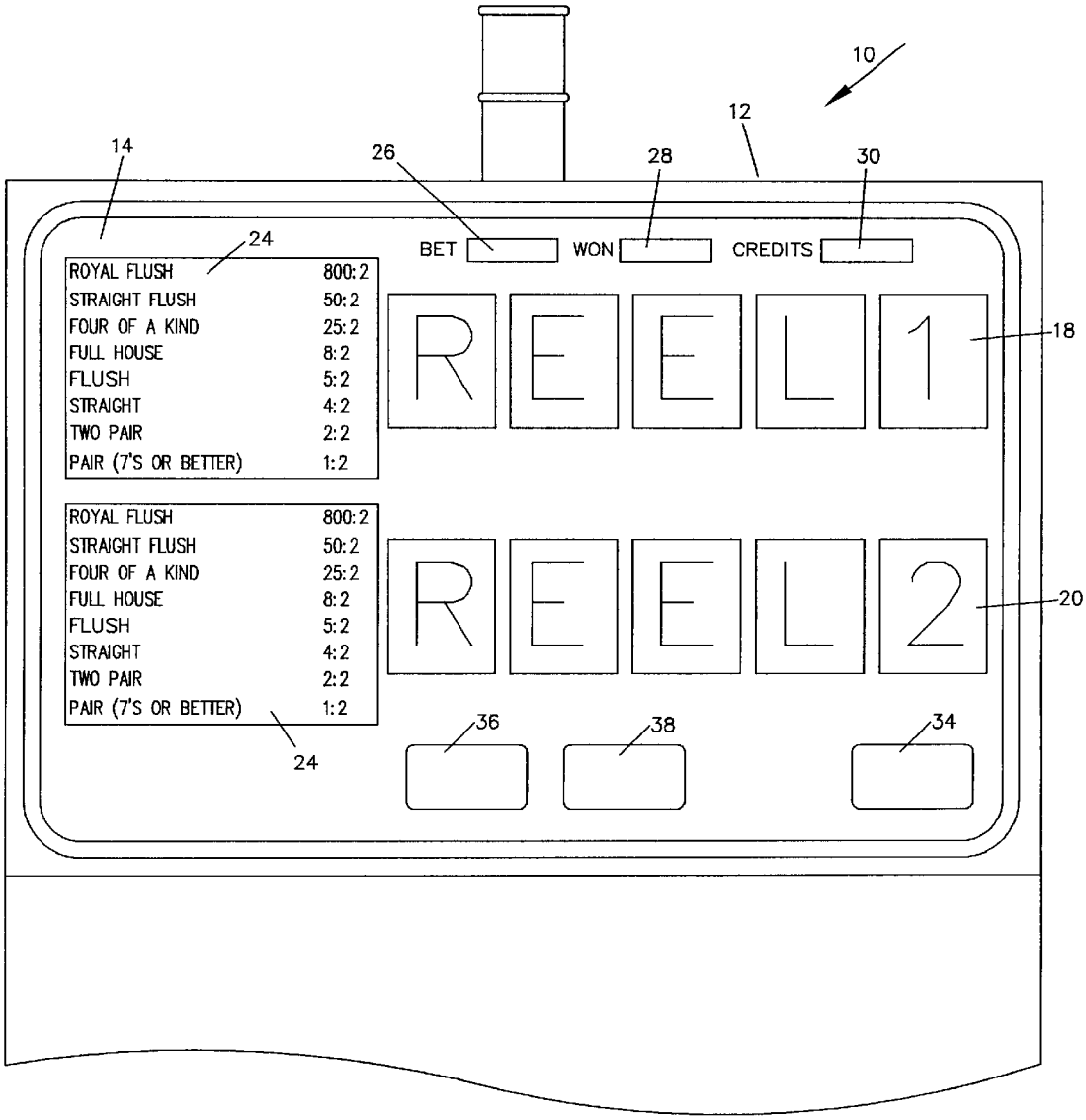
FIG. 4 is a view similar to that of claim 1 showing a further embodiment of the present invention.
Figure 5:
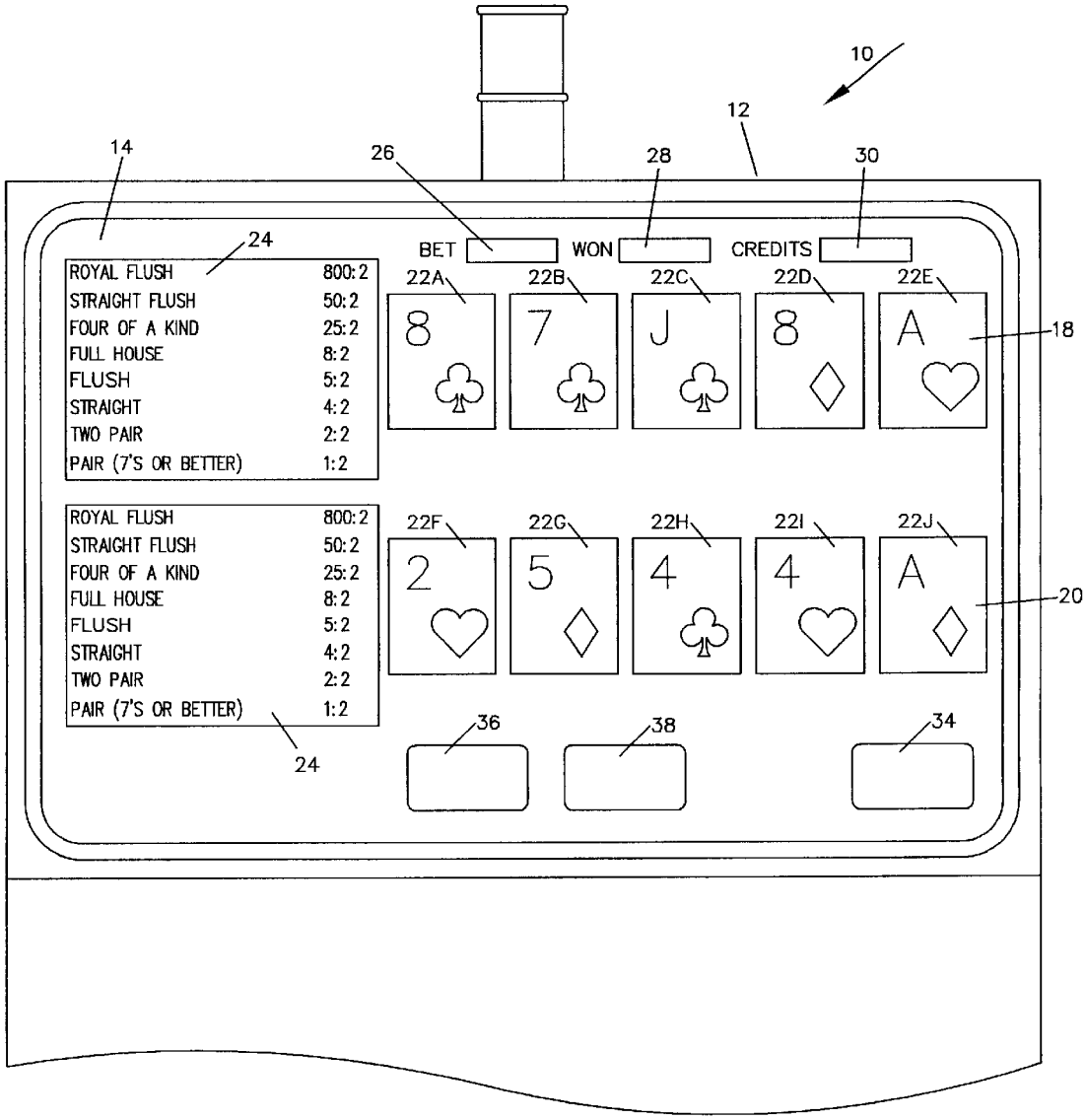
FIG. 5 is a view of the presentation of FIG. 4 showing the display of hands for play according to the method of the present invention.

Turning to FIGS. 4 and 5, yet another embodiment of the present invention is shown. According to this embodiment, the player is only given the decision of how much to bet. Accordingly, and as shown in the drawings, the set hand button 32 is not provided according to this version.

Figure 6:
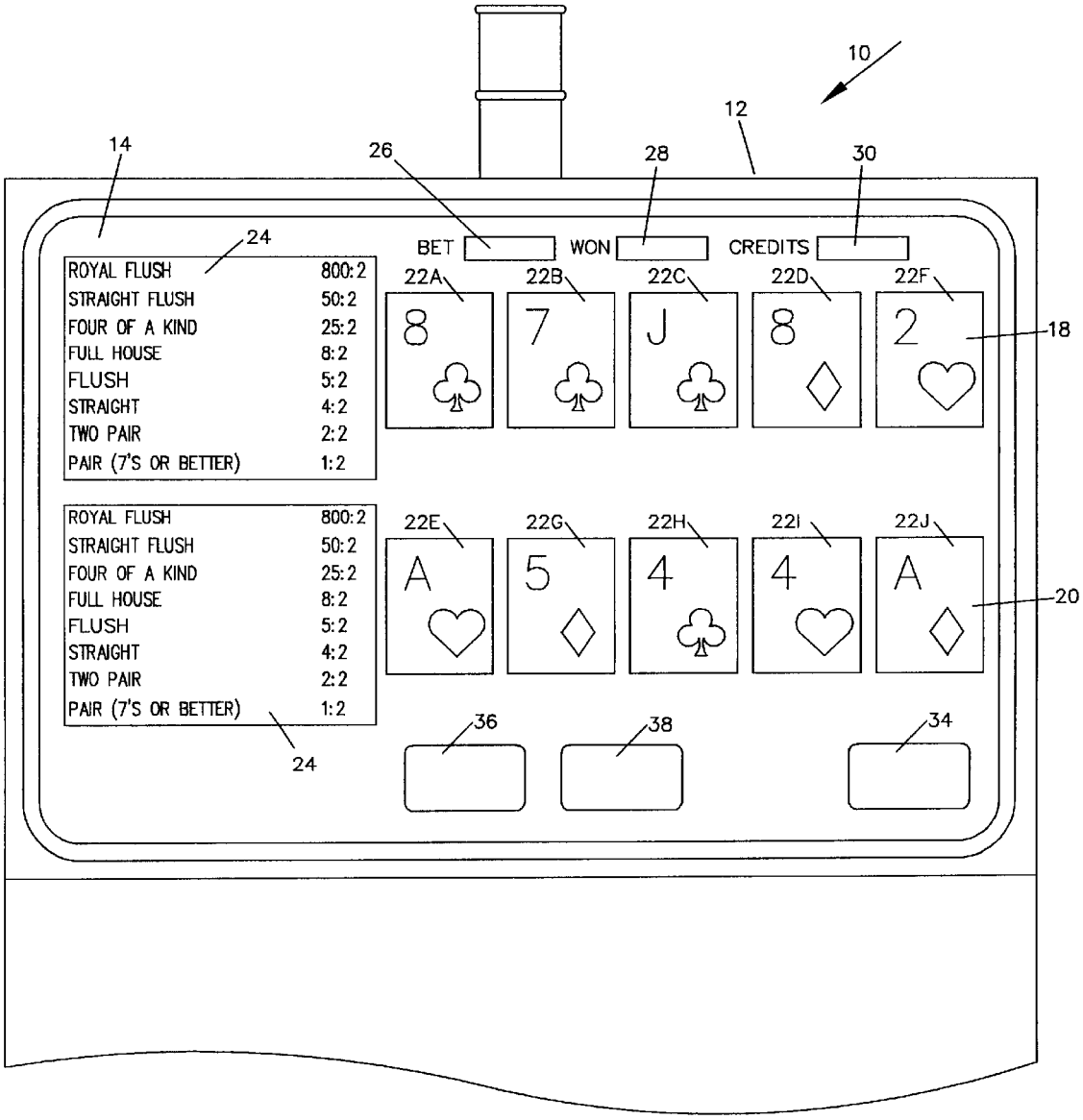
FIG. 6 is a view of the presentation of FIG. 5 showing the display of the hands as reconfigured according to the method of the present invention.

To play the game of the embodiment shown in FIGS. 4 and 5, the player first inputs a wager in the manner described above with reference to the previous embodiment and initiates play. When play is initiated, the processor selects 10 indicia or cards from the first data structure and initially displays the hands as a "REEL 1" and "REEL 2" as a first hand 18 and second hand 20. Thereafter, each of the indicia, shown as cards, is revealed as cards 22*a–j* in a manner described above. If either or both of the first or second hands 18, 20 includes a pre-determined, qualifying holding such as a pair of 7s or better, where the indicia are cards and play is based upon the rules of Poker, as compared to the outcome combinations stored in the second data structure 52, the processor proceeds automatically transform each of the first and second hands to obtain a maximum reward for the play. Thus, as shown in FIG. 5, the initial holding of the first hand includes a qualifying pair of 8s and accordingly, transformation is enabled by the processor. The processor automatically transforms the first and second hands 18, 22 by exchanging cards 22*e* with card 22*f* to obtain for the first hand 18 a qualifying pair of 8s and for the second hand 20 two pair as shown in FIG. 6. The player is then paid based upon the outcomes of both the first and second hands 18, 20 obtained. With the example illustrated in the drawings, and assuming the player has wagered 12 credits, the player would be awarded 3 credits for the first hand for obtaining a pair of 7s and 6 credits for the second hand.

As can be appreciated, rather than using playing cards, other indicia or other numbers of indicia could be used. For example, the first and second hands 18, 20 may be represented by indicia common to slot machines such as 7's, "bar" symbols, cherries or the like with the transformation enabled to maximize the outcome obtained in both hands.

While I have described and shown certain embodiments of the device and methods according to the present invention, it is to be understood that it is subject to many modifications and changes without departing from the spirit and scope of the appended claims.

We claim:

1. A method of playing a poker game comprising:

a) establishing one or more poker hand rankings as winning poker hand rankings;

b) displaying face up a first five card hand and displaying face up a second five card hand;

c) allowing a player to exchange none, one or more cards between the first hand and the second hand so that when the exchange is completed, there is a final first hand face up and a final second hand face up;

d) determining the poker hand ranking of the final first hand and the final second hand; and e) making an award to the player for any winning poker hand rankings achieved in the final first hand and the final second hand.

2. The method of claim 1 further including:

a) a player making a wager to participate in the play of the game; and b) basing the award to the player on the amount of the wager, with a portion of the wager being allocated to the final first hand and a portion of the wager being allocated to the final second hand.

3. The method of claim 2 in which the award to the player is based on a pay table.

4. The method of claim 3 in which the pay table comprises:

| Poker Hand Ranking | Odds |
|---|---|
| Pair of 7's or Better | 1:2 |
| Two Pair | 2:2 |
| Three of a Kind | 3:2 |
| Straight | 4:2 |
| Flush | 5:2 |
| Full House | 8:2 |
| Four of a Kind | 25:2 |
| Straight Flush | 50:2 |
| Royal Flush | 800:2 |

5. The method of claim 2 further including providing a jackpot award based upon a combined poker hand rankings of the final first hand and the final second hand.

6. The method of claim 5 in which the jackpot award is paid if the poker hand ranking of either of the final first hand or the final second hand is a Royal Flush and the poker hand ranking of the other hand is at least Four-of-a-Kind.

7. The method of claim 5 in which the jackpot award is paid if the poker hand ranking of the final first hand and the final second hand are each a Royal Flush.

8. The method of claim 5 further including allocating a portion of the wager to fund the jackpot award.

9. A method of playing a poker game comprising:

a) establishing one or more poker hand rankings as winning poker hand rankings;

b) a player making a wager to participate in the play of the game;

c) displaying face up a first five card hand and displaying face up a second five card hand;

d) if neither the first hand or the second hand has at least a predetermined poker hand ranking, the player loses his wager and the game concludes;

e) if either the first hand or the second hand has at least a predetermined poker hand ranking; then allowing the player to exchange none, one or more cards between the first hand and the second hand so that when the exchange is completed, there is a final first hand face up and a final second hand face up;

f) determining the poker hand ranking of the final first hand and the final second hand; and g) making an award to the player based on the amount of the wager for any winning poker hand rankings achieved in the final first hand and the final second hand, with a portion of the wager being allocated to the final first hand and a portion of the wager being allocated to the final second hand.

10. The method of claim 9 in which the award to the player is based on a pay table.

11. The method of claim 10 in which the pay table comprises:

| Poker Hand Ranking | Odds |
|---|---|
| Pair of 7's or Better | 1:2 |
| Two Pair | 2:2 |
| Three of a Kind | 3:2 |
| Straight | 4:2 |
| Flush | 5:2 |
| Full House | 8:2 |
| Four of a Kind | 25:2 |
| Straight Flush | 50:2 |
| Royal Flush | 800:2 |

12. The method of claim 9 further including providing a jackpot award based upon a combined poker hand rankings of the final first hand and the final second hand.

13. The method of claim 12 in which the jackpot award is paid if the poker hand ranking of either of the final first hand or the final second hand is a Royal Flush and the poker hand ranking of the other hand is at least Four-of-a-Kind.

14. The method of claim 12 in which the jackpot award is paid if the poker hand ranking of the final first hand and the final second hand are each a Royal Flush.

15. The method of claim 12 further including allocating a portion of the wager to fund the jackpot award.

16. The method of claim 9 wherein the predetermined poker hand ranking is a Pair of Sevens or better.

* * * * *